US006786190B2

(12) United States Patent
Wu et al.

(10) Patent No.: US 6,786,190 B2
(45) Date of Patent: Sep. 7, 2004

(54) COMPACT TURBOCHARGED CYLINDER DEACTIVATION ENGINE

(75) Inventors: Ko-Jen Wu, Troy, MI (US); Jack T. Doyle, Howell, MI (US); James C. Elmslie, Oxford, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/303,242

(22) Filed: Nov. 25, 2002

(65) Prior Publication Data

US 2004/0099242 A1 May 27, 2004

(51) Int. Cl.[7] ..... F02B 77/00
(52) U.S. Cl. ..... 123/198 F
(58) Field of Search ..... 123/198 F, 481, 123/561, 562, 563, 564, 565, 566

(56) References Cited

U.S. PATENT DOCUMENTS 4,179,892 A * 12/1979 Heydrich ..... 60/605.2
6,230,682 B1 * 5/2001 Gustafsson et al. ..... 123/323
6,276,138 B1 * 8/2001 Welch ..... 60/602
6,640,543 B1 * 11/2003 Seal ..... 60/609

* cited by examiner

*Primary Examiner*—Tony M. Argenbright
*Assistant Examiner*—Hyder Ali
(74) *Attorney, Agent, or Firm*—Leslie C. Hodges

(57) ABSTRACT

An automotive vehicle engine includes multiple power-producing cylinders including a first group of deactivation cylinders capable of being selectively deactivated during engine operation and a second group of cylinders capable of continued power production during deactivation of the first group. An air intake system includes a turbocharger compressor connected to intake valves of all the cylinders for supplying charge air to the cylinders. An exhaust system includes a turbine connected for driving the compressor, which includes twin scrolls with first and second exhaust flow passages separately connecting the turbine with exhaust valves of the first group of cylinders and with exhaust valves of the second group of cylinders. At high loads, the engine operates on all cylinders and is turbocharged for maximum power. At lower loads, the first group of cylinders may be deactivated and the engine may be driven by the second group of cylinders to obtain increased fuel efficiency.

6 Claims, 1 Drawing Sheet

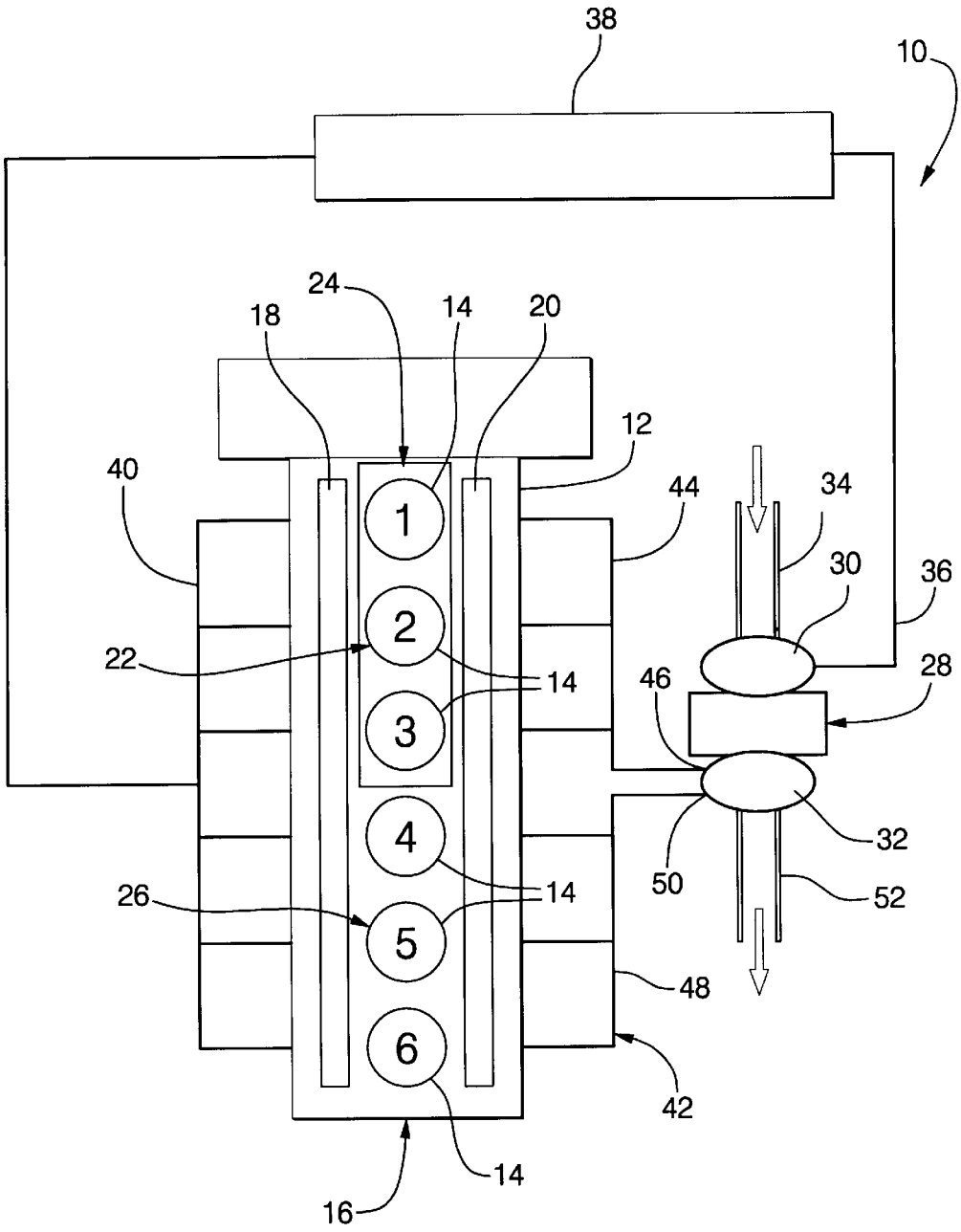
38
10
24
18
14
20
12
40
44
34
30
36
22
14
46
28
32
50
52
26
14
48
42
14
16
1
2
3
4
5
6

COMPACT TURBOCHARGED CYLINDER DEACTIVATION ENGINE

TECHNICAL FIELD

This invention relates to internal combustion engines and, in particular, to turbocharged engines having cylinder deactivation, especially for use in vehicles.

BACKGROUND OF THE INVENTION

It is known in the art relating to automotive vehicle engines that fuel efficiency can be improved by dividing the engine cylinders into two or more groups and deactivating the intake and exhaust valves of one of the cylinder groups for operation of the engine at lower loads where the required power may be developed by the remaining cylinders. It has also been proposed to improve operating efficiency by utilizing a relatively smallsized engine and then increasing its maximum power through turbocharging. In this way, operation under non-turbocharged conditions may be made more fuel efficient by the reduction in throttling needed to operate the engine at the lower load levels required for the greater portion of vehicle driving operation.

To combine these engine concepts, it has been suggested to provide multiple turbochargers, but the complex intake and exhaust systems needed for such arrangements have adversely affected the practicality of such an arrangement.

SUMMARY OF THE INVENTION

The present invention provides a compact practical design which combines the advantages of both cylinder deactivation and turbocharging. Preferably, the engine is provided with an even number of cylinders which are divided into two groups such that the firing intervals of the cylinders in each group are evenly spaced. At least one of the groups of cylinders is provided with valve deactivation devices so that operation of this cylinder group may be deactivated while the engine operated on the cylinders of the other group.

Preferably, a single turbocharger is provided for the engine. The turbocharger is of the twin scroll or divided scroll design wherein the exhaust gases from the two groups of cylinders are fed to the turbine wheel through separate paths in the exhaust manifold and through the separate turbine scrolls where the gases impact the turbine wheel from separate outlets within the turbine housing.

When the engine is operated on all the cylinders, the exhaust gases from all the cylinders are utilized to drive the turbocharger to maximize power output when maximum acceleration or speed conditions are required. Otherwise, the engine cylinders operate at lesser loads and the turbocharger rotates freely.

In order to improve engine efficiency at lower loads, a first group of cylinders may be deactivated so that intake and exhaust gas flow through the deactivated cylinders and to the turbine is cut off. However, the second group of cylinders continues to operate at a higher load factor which is more efficient. Exhaust gas from the second, non-deactivated, group of cylinders is fed to the turbocharger and continues to maintain rotation of the turbine wheel during the cylinder deactivation period. Subsequently, when substantially increased power is called for, the deactivated cylinders are returned to full operation and can provide nearly immediate response of the turbocharger, which has been maintained in a rotating condition during the cylinder deactivation operation mode of the engine.

These and other features and advantages of the invention will be more fully understood from the following description of certain specific embodiments of the invention taken together with the accompanying drawings.

BRIEF DESCRIPTION OF THE DRAWINGS

The single FIGURE of the drawing is a schematic view of an engine having capability for both turbocharged and cylinder deactivation operation and utilizing a single divided scroll turbocharger in accordance with the invention.

DESCRIPTION OF THE PREFERRED EMBODIMENT

Referring now to the drawing in detail, numeral 10 generally indicates a turbocharged automotive vehicle engine including a cylinder block or frame 12 having, for example, six cylinders 14 aligned in a single cylinder bank 16.

The engine cylinders 14 are provided with intake valves 18 and exhaust valves 20 operated by suitable valve actuating gear, not shown. For operating purposes, the cylinders are divided into two groups. A first group 22, including cylinders 1, 2, and 3, is provided with valve deactivation devices 24. A second group 26, including cylinders 4, 5, and 6, has conventional valve mechanisms without deactivation devices, although such deactivation devices could be provided if desired. Both groups of cylinders preferably have evenly-spaced firing intervals of 240 crankshaft degrees offset 120 degrees from the cylinders of the other group.

The engine is provided with a single turbocharger 28 having a compressor 30 and a turbine 32 for driving the compressor. The compressor has an air intake 34 and discharges through a charging line 36 and charge air cooler 38 to an intake manifold 40 that distributes charge air directly to the intake valves 18 for admission to the engine cylinders 14.

An exhaust manifold 42 connects with the exhaust valves of the engine cylinders. However, the exhaust gases from the first group 22 of cylinders 1–3 are conducted through first passages 44 to a first scroll 46 of the turbine. Similarly, the exhaust gases from the second group 26 of cylinders 4–6 are conducted through second passages 48 of the exhaust manifold 42 to a second scroll 50 of the turbine. Spent gases are discharged from a turbine exhaust outlet 52

In operation of the engine 10 with all cylinders firing, intake air is drawn through the compressor 30 and charge air cooler 38 into the intake manifold 40 and distributed equally to the six engine cylinders 14. Exhaust gases from the cylinders 14 are delivered to the separate scrolls 46, 50 of the turbine 32 and the gases are combined in the turbine wheel, not shown. The combined exhaust gases drive the turbocharger 28 at higher power levels so as to boost the pressure of the charge air for increased power operation as required.

When the engine is operated under medium speed cruising or city driving operations that require substantially less than maximum engine power, the valves of the first group 22 of cylinders 1–3 may be deactivated, shutting off air flow through the cylinders and to the first scroll 46 of the turbine 32. The second group 26 of cylinders 4–6 continue to receive air through the intake air system 28, 38, 40 and discharge exhaust gas through the exhaust manifold 42 to the second scroll 50 of the turbine. The discharged exhaust gases maintain turbine wheel rotation during ordinary driving conditions so that the turbine is maintained warm and rotating. Thus, the turbocharger is ready for prompt activation by an increased charge of exhaust gases, through reactivation of the deactivated cylinders, to quickly provide substantially increased and up to maximum engine power. Accordingly, it is apparent that the relatively compact combination of an engine with a single divided scroll turbine and cylinder deactivation provides a compact but effective means for improving engine efficiency while maintaining the requirement for maximum power operation with a minimum of delay. The combination also provides for a compact engine usable in an automotive vehicle with a minimum of complexity and cost.

As desired, an engine according to the invention may have any number of cylinders in excess of one. An even number of cylinders divided equally between two groups is preferred. However, the cylinder groups could have an unequal numbers of cylinders, and there could be more than two groups to permit deactivation of the groups in steps. Control of cylinder deactivation may be provided in any suitable manner to accomplish the goals of increased operating efficiency combined with engine performance capable of meeting the requirements of an associated vehicle.

While the invention has been described by reference to certain preferred embodiments, it should be understood that numerous changes could be made within the spirit and scope of the inventive concepts described. Accordingly, it is intended that the invention not be limited to the disclosed embodiments, but that it have the full scope permitted by the language of the following claims.

What is claimed is:

1. An automotive vehicle engine comprising:

a frame having multiple cylinders;

intake and exhaust valves operable to control the admission of charge air to and the discharge of exhaust gas from the cylinders;

a turbocharger having a compressor for supplying charge air and a turbine adapted to be driven by exhaust gas for driving the compressor to selectively pressurize the charge air;

an intake manifold connecting the compressor with intake passages supplying air to the intake valves;

an exhaust manifold connecting the exhaust valves with the turbine for driving the compressor; and valve gear operable to provide normal actuation of all the engine valves and to selectively deactivate the engine valves of at least some of the engine cylinders, the valves of deactivated cylinders being closed during deactivation to cut off air and exhaust gas flow through the deactivated cylinders;

wherein the turbine has a divided housing with separate passages for conveying exhaust gas to the turbine and the exhaust manifold has separate outlets connected with the separate turbine housing passages, at least one of the manifold outlets being connected with a first group of cylinders that can be deactivated and another of the manifold outlets being connected with a second group of cylinders that can remain operative when the first group is deactivated.

2. An automotive vehicle engine comprising:

a plurality of power producing cylinders including a first group of deactivation cylinders capable of being selectively deactivated during engine operation and a second group of cylinders capable of continued power production during deactivation of the first group;

an intake system including a turbocharger compressor connected to intake valves of all the cylinders for supplying charge air to the cylinders; and an exhaust system including a turbine connected for driving the compressor and first and second exhaust flow passages separately connecting the turbine with exhaust valves of the first group of cylinders and with exhaust valves of the second group of cylinders;

the turbine having a housing including portions of said first and second passages connecting separately with the turbine; and the engine having an exhaust manifold including portions of said first and second passages separately connecting the first and second groups of cylinders with the turbine housing passage portions.

3. An engine as in claim 2 wherein the first and second cylinder groups include equal numbers of cylinders.

4. An engine as in claim 2 wherein the exhaust valves of deactivated cylinders remain closed, cutting off exhaust flow to the turbine from the deactivated cylinders.

5. An engine as in claim 4 wherein the intake valves of deactivated cylinders also remain closed.

6. A engine as in claim 2 wherein the two cylinder groups have equal numbers of cylinders and exhaust gases from both groups drive the turbine during operation of all cylinders, at least at higher loads, and wherein, upon deactivation of the cylinders of the first group, exhaust gases from the second cylinder group conducted to the turbine, alone maintain rotation of the turbine, at least at higher cylinder loads, so that the turbine remains rotating and warm for rapid delivery of maximum charge pressure boost upon return to all cylinder operation of the engine calling for increased power.

* * * * *